US008398293B2

(12) United States Patent
Kim et al.

(10) Patent No.: US 8,398,293 B2
(45) Date of Patent: Mar. 19, 2013

(54) APPARATUS HAVING SWEEPING IMPELLER FOR MIXING VISCOUS MATERIAL

(75) Inventors: In-Seon Kim, Daejeon (KR); Hyun-Seob Song, Daejeon (KR); Sang-Phil Han, London (GB); Ji-Hyun Lee, Daejeon (KR); Hyo-Sook Cha, Daejeon (KR)

(73) Assignee: LG Chem, Ltd., Seoul (KR)

( * ) Notice: Subject to any disclaimer, the term of this patent is extended or adjusted under 35 U.S.C. 154(b) by 528 days.

(21) Appl. No.: 11/652,681

(22) Filed: Jan. 12, 2007

(65) Prior Publication Data

US 2007/0159919 A1 Jul. 12, 2007

(30) Foreign Application Priority Data

Jan. 12, 2006 (KR) ..... 10-2006-0003489

(51) Int. Cl.
*B01F 7/20* (2006.01)
*B01F 7/24* (2006.01)

(52) U.S. Cl. ..... 366/147; 366/264; 366/266; 366/295; 366/325.4; 366/325.93; 366/328.4; 366/149; 422/227; 422/229

(58) Field of Classification Search ..... 165/DIG. 84, 165/DIG. 149, DIG. 151, DIG. 308, DIG. 309; 366/266, 325.4, 325.5, 325.93, 318–324, 366/96–98, 328.2–328.4, 264, 329.1–329.3, 366/330.1, 325.92, 147, 149; 422/227, 229, 422/295, 325.4, 325.92, 325.93; 416/177
See application file for complete search history.

(56) References Cited

U.S. PATENT DOCUMENTS

| | | | | | |
|---|---|---|---|---|---|
| 400,807 | A | * | 4/1889 | Toepfer | 366/266 |
| 490,475 | A | * | 1/1893 | Holden | 165/94 |
| 664,130 | A | * | 12/1900 | Culmann et al. | 366/149 |
| 787,143 | A | * | 4/1905 | de Sampaio Barros | 366/295 |
| 808,319 | A | * | 12/1905 | Valerius | 165/108 |
| 824,075 | A | * | 6/1906 | Gerner | 366/204 |
| 964,935 | A | * | 7/1910 | Poulin et al. | 165/109.1 |
| 1,256,460 | A | * | 2/1918 | Folger | 165/94 |
| 1,420,210 | A | * | 6/1922 | Paulus | 165/94 |
| 1,483,742 | A | * | 2/1924 | Nicol | 554/175 |
| 2,367,149 | A | * | 1/1945 | Smith | 366/144 |
| 2,460,987 | A | * | 2/1949 | Kanhofer | 422/200 |

(Continued)

FOREIGN PATENT DOCUMENTS

| | | | |
|---|---|---|---|
| JP | 42-3394 | | 4/1967 |
| JP | 57045333 | A * | 3/1982 |

(Continued)

*Primary Examiner* — Charles E Cooley
(74) *Attorney, Agent, or Firm* — McKenna Long & Aldridge LLP

(57) ABSTRACT

An apparatus for mixing viscous material includes a chamber having a cylindrical sidewall and a bottom and receiving viscous material to be mixed; a cylindrical draft tube fixed at an inside center of the chamber to be spaced from the bottom and the sidewall and forming a space between the draft tube and the sidewall to allow passage of the viscous material, and including a heat medium passage therein; a carrying impeller installed in the draft tube and driven by a motor to transfer the viscous material above or below the draft tube and suck the viscous material in the space into the draft tube; and a sweeping impeller installed in the space and rotated in a circumferential direction by a motor to apply a pressure to the viscous material so that the viscous material in the space is not adhered to the draft tube and the sidewall.

8 Claims, 7 Drawing Sheets

U.S. PATENT DOCUMENTS

| | | | | | |
|---|---|---|---|---|---|
| 2,758,823 | A | * | 8/1956 | Vasby | 366/318 |
| 3,150,862 | A | * | 9/1964 | Grabauskas | 366/181.8 |
| 3,206,287 | A | * | 9/1965 | Crawford | 422/135 |
| 3,445,090 | A | * | 5/1969 | Lucke | 366/266 |
| 3,476,522 | A | * | 11/1969 | Stovall | 422/135 |
| 3,567,402 | A | * | 3/1971 | Christensen | 422/109 |
| 3,910,346 | A | * | 10/1975 | ter Braak | 165/109.1 |
| 4,007,016 | A | * | 2/1977 | Weber | 422/205 |
| 4,105,066 | A | * | 8/1978 | Buhler | 165/94 |
| 4,232,973 | A | * | 11/1980 | Ligouzat | 366/156.2 |
| 4,279,295 | A | * | 7/1981 | Duckworth | 165/94 |
| 4,391,529 | A | * | 7/1983 | Hedrich et al. | 366/266 |
| 4,472,063 | A | * | 9/1984 | Eickelmann | 366/129 |
| 4,893,943 | A | * | 1/1990 | McKelvey | 366/312 |
| 4,900,158 | A | * | 2/1990 | Ugolini | 366/143 |
| 5,165,469 | A | * | 11/1992 | Smith | 165/94 |
| 5,524,706 | A | * | 6/1996 | Nakamura et al. | 165/47 |
| 5,603,229 | A | * | 2/1997 | Cocchi et al. | 62/343 |
| 5,823,673 | A | * | 10/1998 | Muntener | 366/303 |
| 6,105,275 | A | * | 8/2000 | Aulbaugh et al. | 34/424 |
| 6,227,698 | B1 | * | 5/2001 | Muntener | 366/303 |
| 6,280,076 | B1 | * | 8/2001 | Muntener | 366/149 |
| 6,752,530 | B2 | * | 6/2004 | Pecis | 366/295 |
| 7,207,376 | B2 | * | 4/2007 | Dyhr | 165/91 |
| 2007/0159919 | A1 | * | 7/2007 | Kim et al. | 366/147 |

FOREIGN PATENT DOCUMENTS

| | | | | |
|---|---|---|---|---|
| JP | 60238128 | A | * | 11/1985 |
| JP | 60244329 | A | * | 12/1985 |
| JP | 61103529 | A | * | 5/1986 |
| JP | 63-77529 | A | * | 4/1988 |
| JP | 02048026 | A | * | 2/1990 |
| JP | 09206578 | A | * | 8/1997 |

* cited by examiner

APPARATUS HAVING SWEEPING IMPELLER FOR MIXING VISCOUS MATERIAL

This application claims the benefit of Korean Patent Application Nos. 10-2006-0003489 filed on Jan. 12, 2006, which is hereby incorporated by reference for all purposes as if fully set forth herein.

BACKGROUND OF THE INVENTION

1. Field of the Invention

The present invention relates to an apparatus for mixing viscous material.

2. Description of the Related Art

In a viscous material mixing device for mixing high-viscosity polymer material with a viscosity over a certain level to induce reaction for the purpose of obtaining a desired polymer product, one of the important factors is effective heat exchange, namely rapidly discharging the heat, generated during the reaction, out of the mixing device or effectively supplying heat required for the reaction. The heat exchange includes cooling or heating polymer material by applying coolant or heating agent to the mixing device.

For performing the heat exchange, a chamber in which polymer material is stirred should be cooled. However, if the polymer material is adhered to the wall of the chamber due to their viscosity, the heat of coolant or heating agent is not easily transferred into the chamber. In severe cases, it may be impossible to produce a polymer product including a heat-sensitive reaction process.

FIG. 1 shows an example of a conventional viscous material mixing device 11.

As shown in FIG. 1, the conventional mixing device 11 includes a chamber 13 for receiving high-viscosity material Z to be mixed, a draft tube 19 fixed in the chamber 13, and a carrying impeller 30 rotatably installed in the draft tube 19 and driven using the power transmitted from an external motor 31.

The chamber 13 includes a bottom 13*a*, a cylindrical sidewall 13*b* fixed to the bottom to form an inner space 13*c* of a predetermined capacity, and a cover 14 for covering the upper portion of the sidewall 13*b*. In particular, a heat medium passage 15 is provided in the sidewall 13*b*. The heat medium passage 15 is connected to a heat medium supply pipe 17*a* and a heat medium discharge pipe 17*b*, and it receives a heat medium supplied through the heat medium supply pipe 17*a*, flows the heat medium therein and then discharge the heat medium through the heat medium discharge pipe 17*b*. The heat medium passes through the heat medium passage 15 and it is used for heat exchange with the high-viscosity material Z.

The draft tube 19 is a cylindrical member with a constant diameter, and its upper and lower ends are open. The draft tube 19 is spaced apart from the bottom 13*a* by means of a plurality of legs 20. In addition, a heat medium passage 21 is also provided in a sidewall 19*a* of the draft tube 19. The heat medium passage 21 is connected to a heat medium supply pipe 23*a* and a heat medium discharge pipe 23*b*, and it allows the heat medium supplied through the heat medium supply pipe 23*a* to flow therein and then discharges the heat medium through the heat medium discharge pipe 23*b*. The heat medium passing through the heat medium passage 21 is also used for heat exchange with the high-viscosity material Z.

Meanwhile, the carrying impeller 30 installed in the draft tube 19 includes a driving shaft 27 vertically extended and axially rotated with a torque transmitted from the motor 31, and a blade 29 fixed to the outer circumference of the driving shaft 27 and spirally extended thereon. In particular, the outer front end of the blade 29 is as closer to the inner circumference of the draft tube 19 as possible.

A flow guider 25 is provided below the carrying impeller 30. The flow guider 25 has a conical shape inclined downward in a radial direction, and the flow guider 25 guides the high-viscosity material Z, moving downward through the carrying impeller 30, to a space 33 between the draft tube 19 and the chamber 13.

Reference numeral 28 designates a bearing. The bearing 28 is positioned at the center of the cover 14 and the flow guider 25 and supports the driving shaft 27 vertically.

If the carrying impeller 30 of the mixing device 11 configured as mentioned above is driven, the high-viscosity material Z in the draft tube 19 moves down along the arrowed direction out of the draft tube 19, and then the high-viscosity material Z is guided in a radial direction by the flow guider 25 and moves upward via the space 33.

The space 33 is an empty space between the draft tube 19 and the sidewall 13*b*, acting as a passage for the high-viscosity material Z to move upward. The high-viscosity material Z passing through the space 33 upward is sucked into the draft tube 19 due to the action of the carrying impeller 30. As a result, the high-viscosity material Z is mixed with circulating a path of moving downward out of the draft tube 19 and flowing upward through the space 33, and then returning to the draft tube 19.

While the high-viscosity material Z is circulated, the heat medium continuously passes through the heat medium passages 15, 21. The heat medium is used for cooling or heating the high-viscosity material Z, and the heat possessed by the heat medium is transferred to the high-viscosity material Z through the thickness of the sidewalls 19*a*, 13*b*.

In particular, the high-viscosity material Z is pressed in an arrow C direction and pushed outward by the rotating blade 29. At this time, due to the cohesion of the high-viscosity material itself and the kinetic energy applied by the blade 29 in the arrow C direction, the high-viscosity material positioned near the front end of the blade 29 is cut to form a space E.

The space E is a portion to which the high-viscosity material is not adhered, and it may allow the heat to rapidly pass through the sidewall 19*a* in its thickness direction, not being disturbed by the high-viscosity material. That is to say, the space E allows the heat, transferred from outside, to reach more deeply into the draft tube 19 due to the convection, thereby improving the heat exchange efficiency. An arrow A designates a flow of hot or cold air supplied from the heat exchange medium.

However, the conventional mixing device 11 shows low heat exchange efficiency in areas except the inner circumference of the draft tube 19 (e.g., the outer circumference of the draft tube or the inner circumference of the sidewall).

If the high-viscosity material Z is not adhered to the heat exchange path, the supplied heat may pass through only the sidewalls 13*b*, 19*a* and be transferred more deeply into the high-viscosity material Z. However, since the high-viscosity material is adhered to the outer circumference of the draft tube and the inner circumference of the sidewall, the adhered layer disturbs heat transfer (though the adhered layer allows heat exchange to some extent), and thus the heat cannot reach the inside of the high-viscosity material.

FIG. 2 is for illustrating flow characteristics in an A portion of the mixing device of FIG. 1.

As shown in FIG. 2, as for the high-viscosity material Z passing through the space 33 upward, it would be understood that high-viscosity material located near the sidewalls 13*b*, 19*a* is nearly not flowing since its flowing rate is very low in comparison to the main stream at the center. It is due to the viscosity possessed by the high-viscosity material.

The high-viscosity material stagnated near the sidewalls 13*b*, 19*a* is positioned as one adhered layer, which disturbs the heat supplied from the heat medium not to be transferred into the space 33. That is to say, the adhered layer reduces the heat exchange efficiency in the mixing device.

As mentioned above, the conventional mixing device has very low heat exchange efficiency since high-viscosity material to be mixed is adhered to the inner wall of the chamber or the draft tube, and accordingly the conventional mixing device cannot be applied to treating material that should be mixed only below a certain temperature.

SUMMARY OF THE INVENTION

The present invention is designed to solve the problems of the prior art, and therefore it is an object of the present invention to provide an apparatus for mixing viscous material, capable of effectively controlling temperature of the mixing material due to its good heat exchange efficiency, accordingly allowing production of polymer products, which was impossible by a conventional mixing device due to the limit of the heat exchange capability, and also reducing an amount of heat medium used and thus reducing a production cost as much.

In order to accomplish the above object, the present invention provides an apparatus for mixing viscous material, including a chamber having a cylindrical sidewall and a bottom, the chamber receiving viscous material to be mixed; a cylindrical draft tube fixed at an inside center of the chamber to be spaced apart from the bottom, the draft tube being spaced apart from the sidewall of the chamber and forming a space between the draft tube and the sidewall of the chamber so that the viscous material passes through the space, the draft tube including a heat medium passage therein through which a heat medium supplied from outside passes; a carrying impeller installed in the draft tube and driven by a power supplied from an external driving means to transfer the viscous material above or below the draft tube and suck the viscous material located in the space into the draft tube; and a sweeping impeller installed in the space and rotated in a circumferential direction of the draft tube with the power supplied from an external driving means to apply a pressure to the viscous material so that the viscous material in the space is not adhered to an outer circumference of the draft tube and an inner circumference of the sidewall of the chamber.

In another aspect of the present invention, there is also provided an apparatus for mixing viscous material, including a chamber having a cylindrical sidewall and a bottom, the chamber receiving viscous material to be mixed; a plurality of cylindrical draft tubes fixed at an inside center of the chamber to be spaced apart from the bottom, the draft tubes being spaced apart from the sidewall of the chamber with the same center and different diameters, the draft tubes passing the viscous materials through a space between the draft tubes and a space between the greatest draft tube and the sidewall, the draft tubes including heat medium passages therein through which a heat medium supplied from outside passes; a carrying impeller installed to a smallest one of the draft tubes and driven by the power supplied from an external driving means to carry the viscous material above or below the draft tubes and suck in the viscous material located in the spaces; and a plurality of sweeping impellers installed in the spaces and rotated in a circumferential direction of the draft tubes with the power supplied from an external driving means to apply a pressure to the viscous material so that the viscous material in the spaces is not adhered to facing surfaces of the draft tubes and facing surfaces of the draft tube and the chamber.

Preferably, a heat medium passage for allowing a heat medium supplied from outside to pass therethrough is provided in the sidewall of the chamber.

Also preferably, the carrying impeller includes a driving shaft positioned on a central axis of the draft tube and axially rotated with a torque transmitted from outside; and a spiral blade fixed to an outer circumference of the driving shaft and extended in a screw shape, the spiral blade having a front end spaced apart from an inner circumference of the draft tube by a predetermined distance, wherein the sweeping impeller has a plate shape parallel with the driving shaft, edges of the sweeping impeller in a width direction being spaced apart from the inner circumference of the sidewall of the chamber and the outer circumference of the draft tube by a predetermined distance, and wherein the apparatus further comprises a rotating rod acting as a driving means for transferring a rotating force to the sweeping impeller, the rotating rod being fixed to the driving shaft and extended to an upper portion of the space, the sweeping impeller being coupled to an end of the rotating rod.

In addition, it is preferred that the sweeping impeller has constant thickness and width, and while being rotated, the sweeping impeller allows an edge thereof in a width direction to separate the viscous material adhered to the inner circumference of the sidewall of the chamber and the outer circumference of the draft tube from an adhesion surface, thereby promoting heat exchange between the corresponding adhesion surface and the heat medium.

Also preferably, an upper end of the sweeping impeller is fixed to the rotating rod, and the sweeping impeller has a plurality of through holes for the viscous material to pass therethrough so as to reduce a flow resistance caused by the viscous material while the sweeping impeller is rotating.

There may be provided a plurality of rotating rods arranged at regular angles, an upper end of the sweeping impeller is fixed to each rotating rod, and the sweeping impeller is reinforced with a frame so as to prevent deformation due to a flow resistance caused by the viscous material while the sweeping impeller is rotating.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Figure 1:
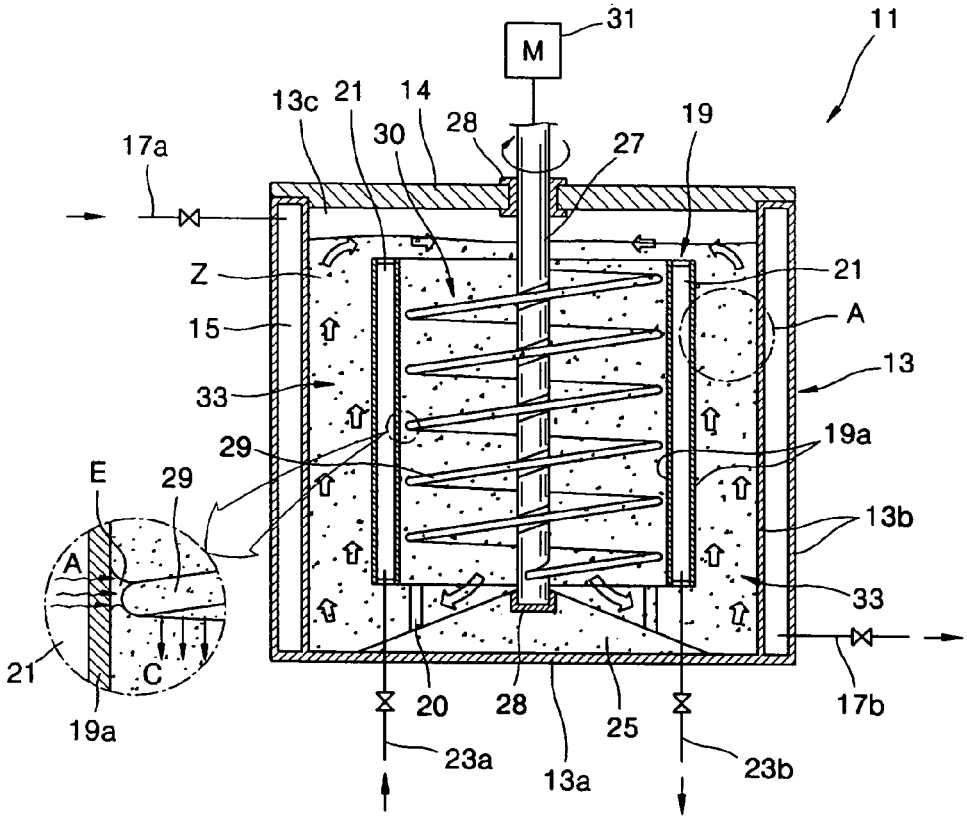
FIG. 1 (PRIOR ART)
FIG. 1 is a sectional view showing an example of a conventional viscous material mixing device.
Figure 2:
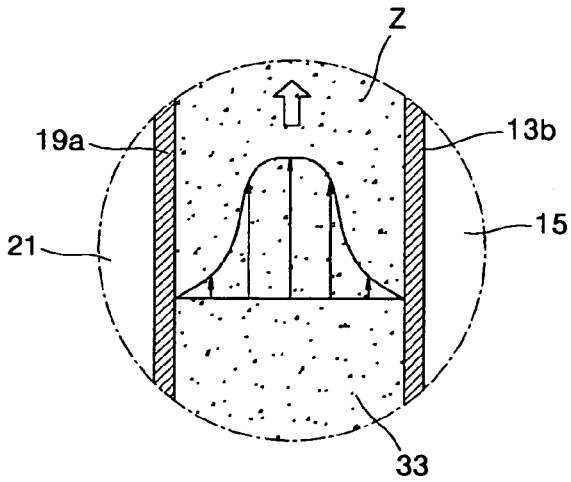
FIG. 2 (PRIOR ART)
FIG. 2 is a schematic view illustrating flow characteristics in an A portion of the mixing device of FIG. 1.

Hereinafter, preferred embodiments of the present invention will be described in detail with reference to the accompanying drawings. In the drawings, the same reference numeral denotes the same component having the same function.

Figure 3:
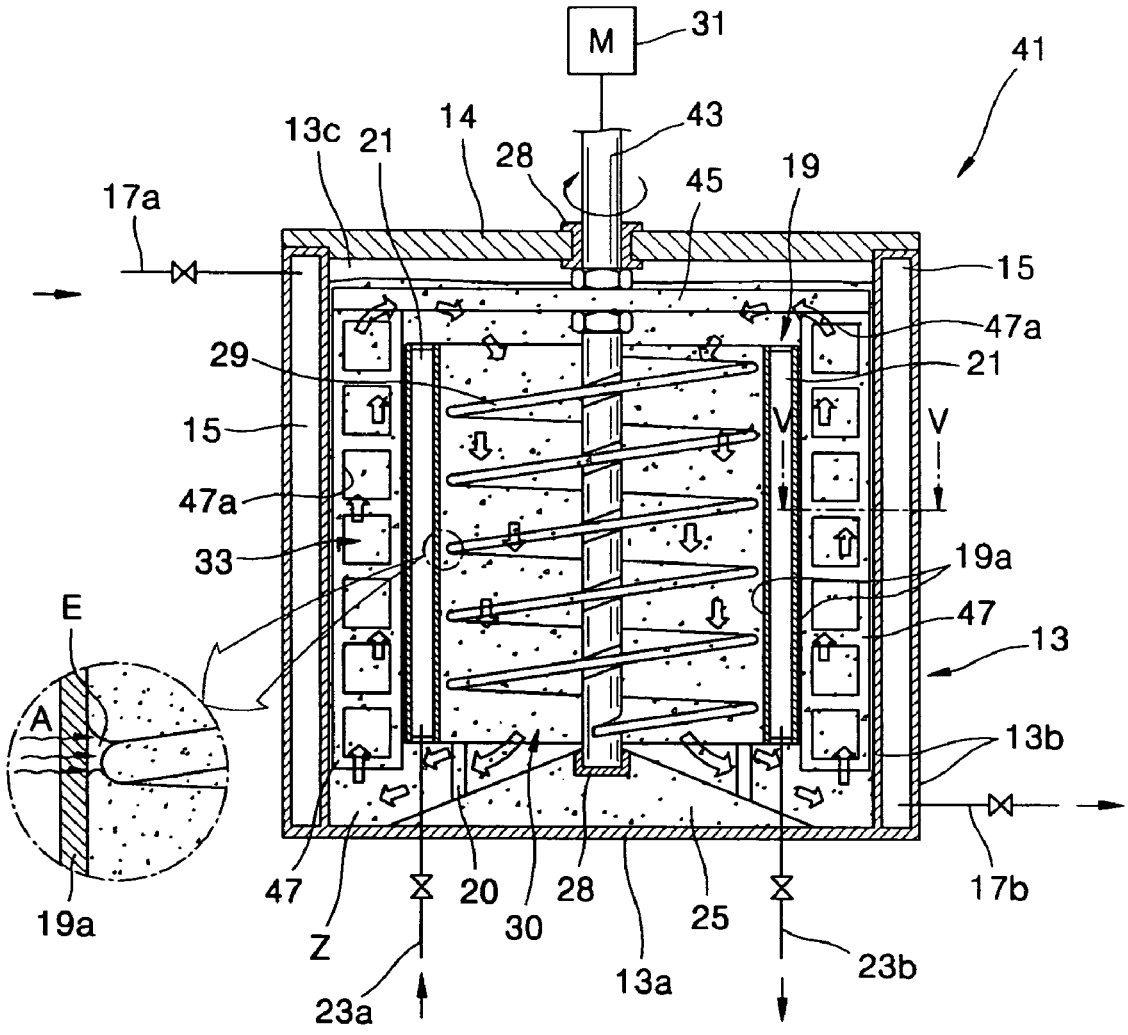
FIG. 3 is a sectional view showing an apparatus for mixing viscous material according to one embodiment of the present invention.

FIG. 3 is a sectional view showing an apparatus for mixing viscous material according to an embodiment of the present invention.

Referring to FIG. 3, the viscous material mixing apparatus 41 of this embodiment includes a chamber 13 for receiving high-viscosity material Z to be mixed, a draft tube 19 fixed in the chamber 13 and having a lower end spaced apart from a bottom 13*a* of the chamber 13, and a carrying impeller 30 installed to an inside of the draft tube 19 and driven by an external motor 31 to push the high-viscosity material Z downward. Each of the components has been already illustrated with reference to FIG. 1, so it is not described in detail again.

In particular, the mixing apparatus 41 of this embodiment includes a sweeping impeller 47. The sweeping impeller 47 is a plate-shaped member vertically positioned in the space 33 (namely, a space between the outer circumference of the draft tube 19 and the inner circumference of the chamber sidewall 13*b*), and it is driven together with the carrying impeller 30.

Figure 4:
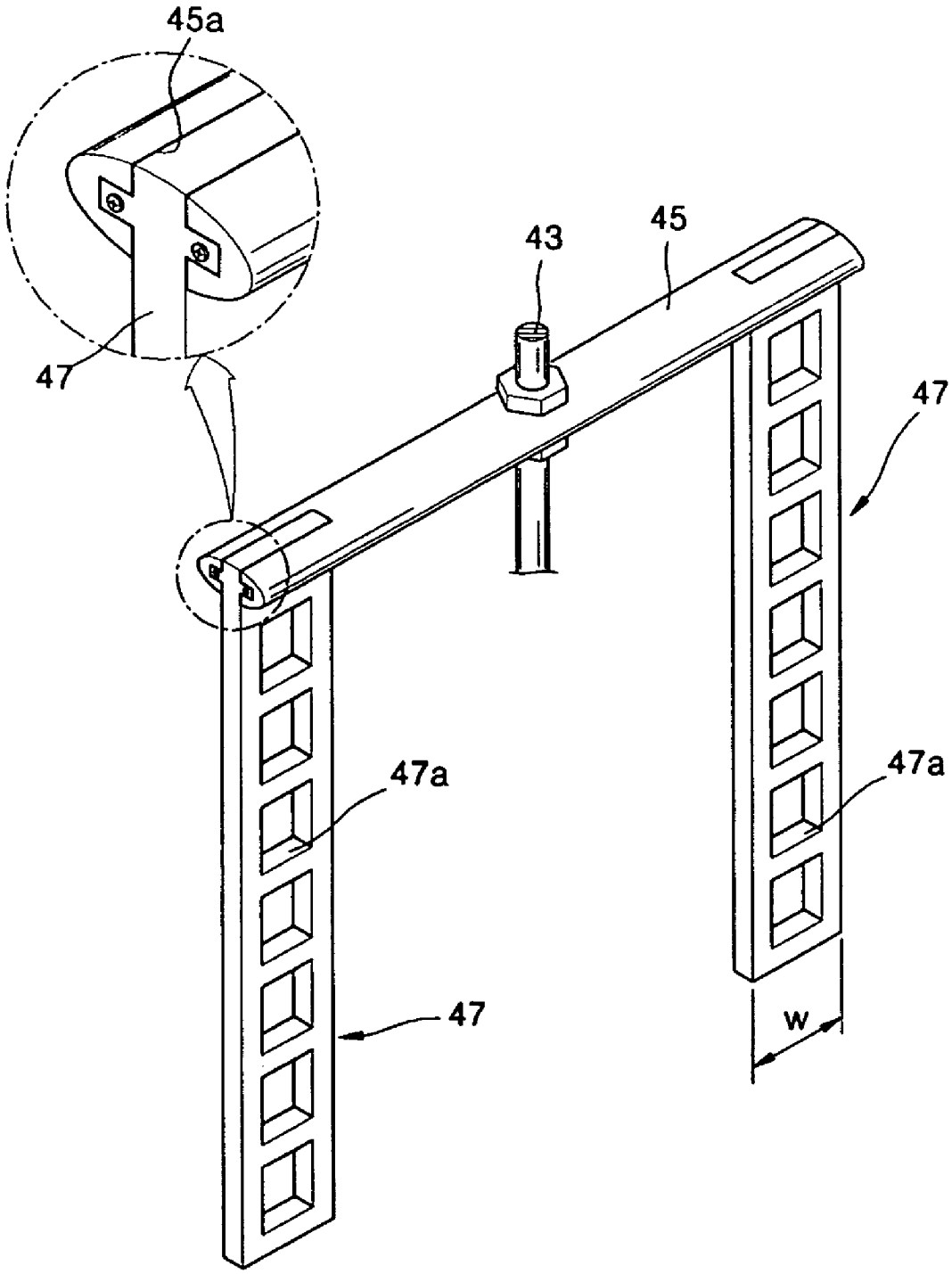
FIG. 4 is a perspective view showing a sweeping impeller and a rotating rod of FIG. 3.

The sweeping impeller 47 is shaped as shown in FIG. 4, and both edges of the sweeping impeller 47 in its width direction are very close to the outer circumference of the draft tube 19 and the inner circumference of the chamber 13. The distance between them varies depending on the viscosity of the viscous material, and they are closer as the viscosity is smaller. The width w (see FIG. 4) of the sweeping impeller 47 is preferably 85% to 95% of the interval between the outer circumference of the draft tube 19 and the inner circumference of the chamber 13.

In addition, the mixing apparatus 41 of this embodiment is further provided with a rotating rod 45 so as to transfer a driving force to the sweeping impeller 47. The rotating rod 45 is a member horizontally extended in both sides with its center being fixed to a driving shaft 43, and the sweeping impeller 47 is mounted to its extended end.

FIG. 4 is a perspective view showing the sweeping impeller and the rotating rod of FIG. 3 in more detail.

Referring to FIG. 4, it would be understood that the rotating rod 45 is fixed to the driving shaft 43. The rotating rod 45 is a rigid body horizontally extended with its center being fixed to the driving shaft 43, and the sweeping impellers 47 are coupled to both ends of the rotating rod 45. In particular, the rotating rod 45 has an oval section. Due to the oval section, the rotating rod 45 may minimize the resistance caused by the high-viscosity material Z when the rotating rod 45 rotates inside the high-viscosity material Z.

The sweeping impellers 47 fixed to both ends of the rotating rod 45 are a rectangular member having constant width w and thickness and extended in parallel with the driving shaft 43. The sweeping impeller 47 rotates together with a blade 29 (see FIG. 3) when the driving shaft 43 rotates axially, thereby pushing the high-viscosity material Z located inside the space 33 toward one direction.

In addition, a plurality of through holes 47*a* are formed in the sweeping impeller 47. The through holes 47*a* allow the high-viscosity material to pass through them so that a resistance caused by the high-viscosity material Z is minimized when the sweeping impeller 47 is rotating inside the space 33.

The sweeping impeller 47 may be fixed to the rotating rod 45 in various ways. For example, it is possible that mount slits 45*a* are formed in both ends of the rotating rod 45, and then the upper end of the sweeping impeller 47 is inserted and fixed into the mount slits 45*a*.

Figure 5:
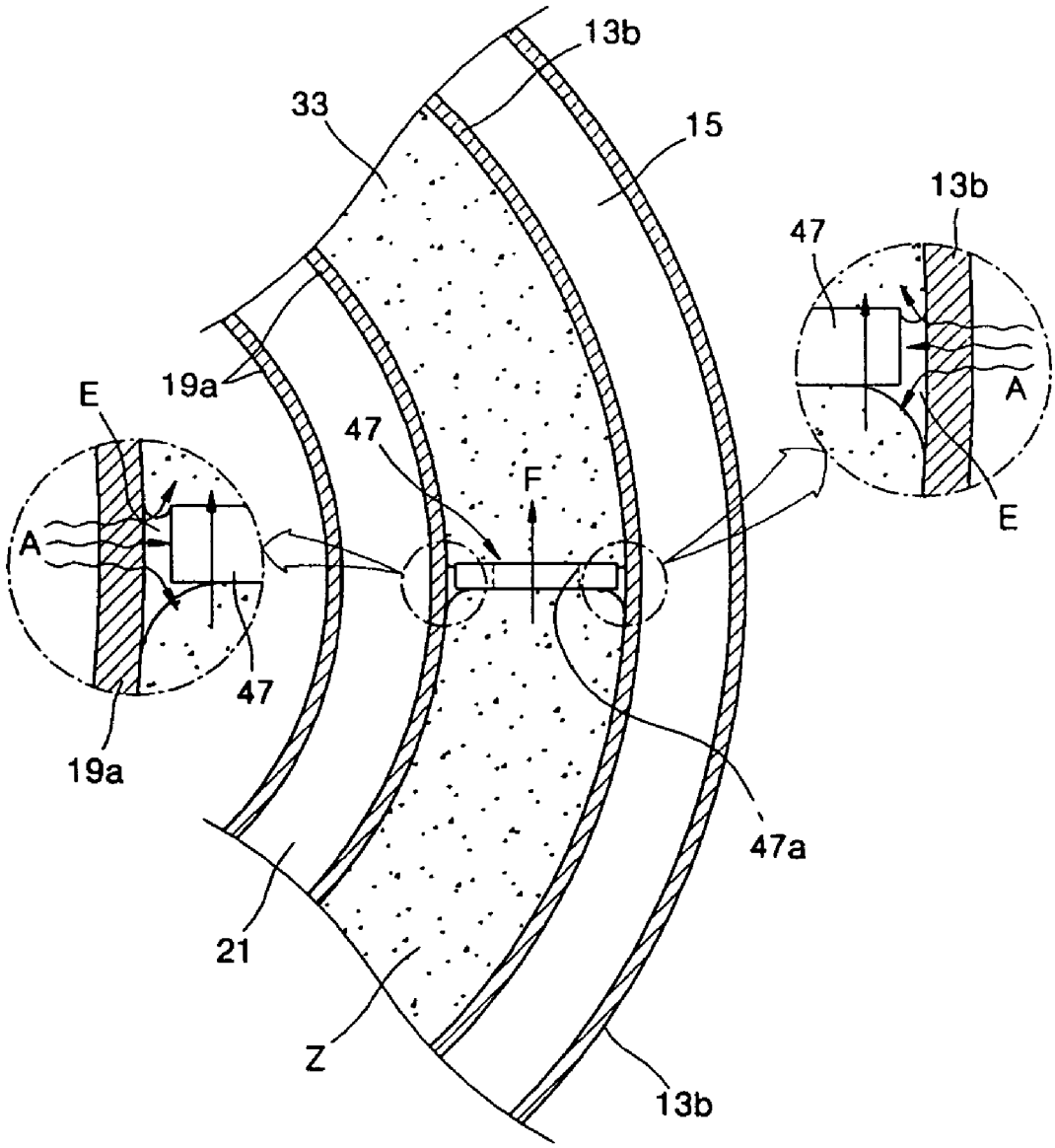
FIG. 5 is a sectional view taken along the line V-V of FIG. 3.

FIG. 5 is a sectional view taken along the line V-V of FIG. 3.

As shown in FIG. 5, the sweeping impeller 47 is installed inside the space 33. The width direction of the sweeping impeller 47 is orthogonal to a tangential direction of the outer circumference of the draft tube 19. In addition, the ends of the sweeping impeller 47 in its width direction are as closer to the outer circumference of the draft tube 19 and the inner circumference of the chamber 13 as possible.

In any case, if the sweeping impeller 47 is rotated in an F direction, both ends of the sweeping impeller 47 sweep the high-viscosity materials adhered to the outer circumference of the draft tube 19 and the inner circumference of the chamber 13, thereby forming a space part E on the corresponding surface. The space part E is formed by the kinetic energy of the sweeping impeller and the viscosity of the high-viscosity material Z, and it increases an amount of heat convention in an arrow A direction.

That is to say, the space part E has no high-viscosity material Z on the sidewalls 13*b*, 19*a* (namely, the high-viscosity material Z does not disturb heat flow in the space part E), more amount of heat enters into the space 33. The heat includes a cooling energy as well as a high-temperature thermal energy.

Figure 6:
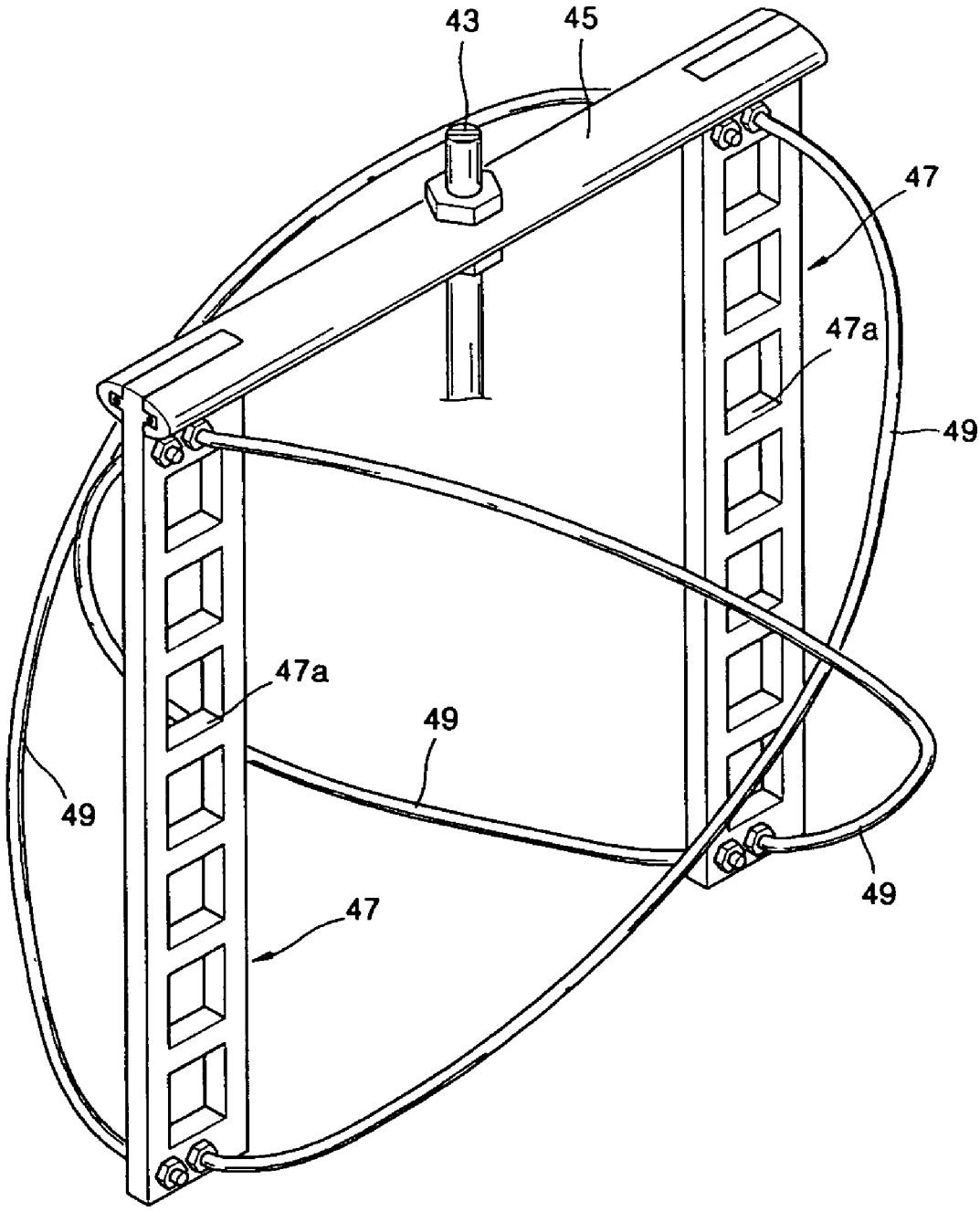
FIG. 6 is a perspective view showing the sweeping impeller of FIG. 4, reinforced with frames.

FIG. 6 shows that the sweeping impeller of FIG. 4 is reinforced with a frame.

Referring to FIG. 6, it would be understood that the sweeping impellers 47 fixed to both ends of the rotating rod 45 are connected with a reinforcing frame 49. The reinforcing frame 49 is a steel beam in a curved shape, whose one end is fixed to the upper end of one sweeping impeller and the other end is fixed to the lower end of the other sweeping impeller. The reinforcing frame 49 is curved in a suitable curvature and positioned inside the space 33 together with the sweeping impellers 47.

When the sweeping impeller 47 rotates with stirring the inside of the space 33, the reinforcing frame 49 plays a role of preventing the sweeping impeller 47 from being bent in an opposite direction to the rotating direction due to the resistance of the high-viscosity material Z. Any other kinds of reinforcing means may be used instead of the reinforcing frame 49.

Figure 7:
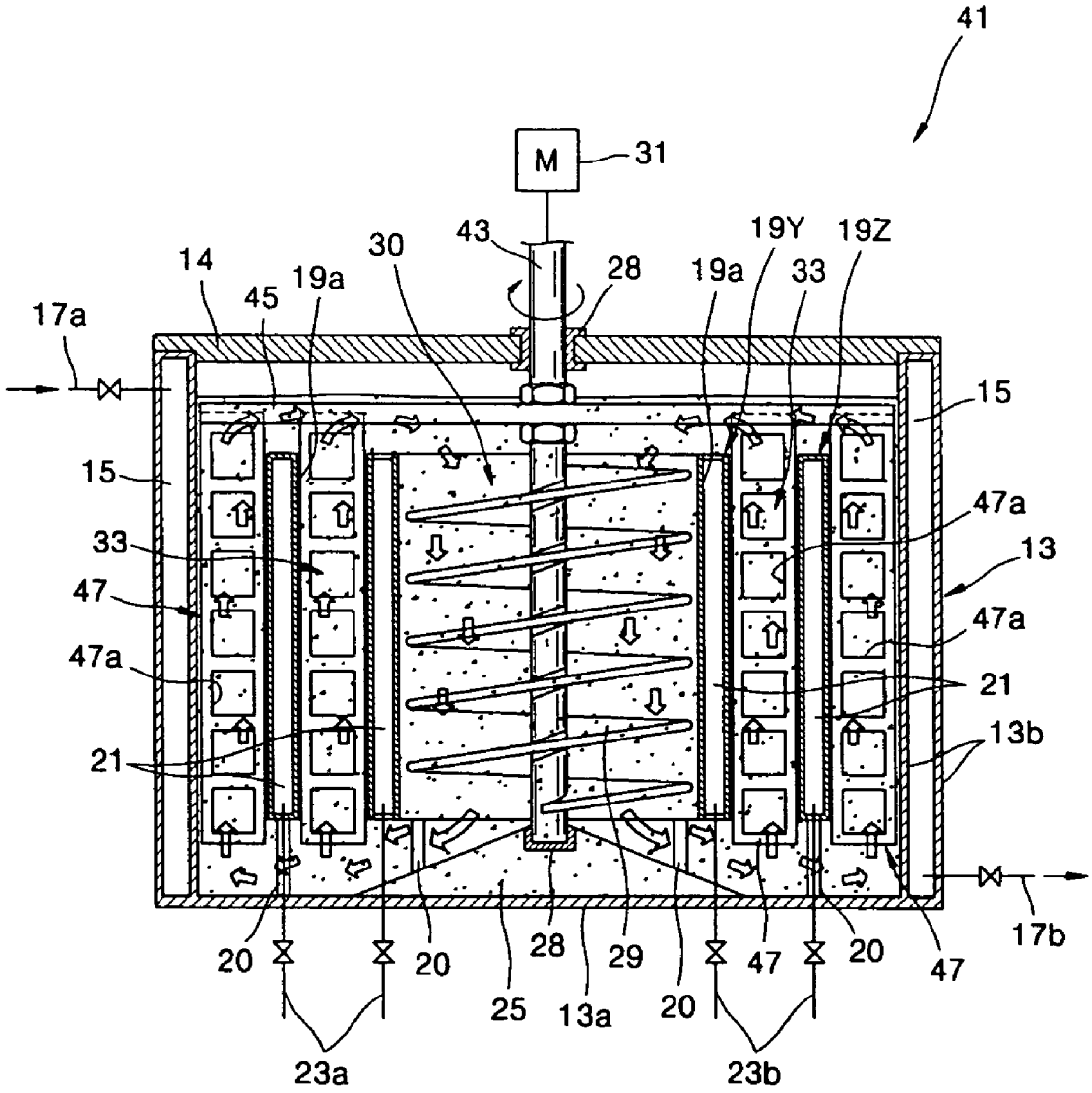
FIG. 7 is a sectional view showing an apparatus for mixing viscous material according to another embodiment of the present invention.

FIG. 7 shows another example of the viscous material mixing apparatus according to one embodiment of the present invention.

Referring to FIG. 7, it would be understood that two draft tubes 19*y*, 19*z* are provided in the chamber 13. The draft tubes 19*y*, 19*z* have the same central axis but different diameters.

Among two draft tubes 19*y*, 19*z*, a draft tube 19*y* positioned inside receives the carrying impeller 30. In addition, the other draft tube 19*z* surrounds the inner draft tube 19*y* and is positioned in the middle of the draft tube 19*y* and the sidewall 13*b* of the chamber 13.

There are provided spaces 33 respectively between the draft tubes 19*y*, 19*z* and between the outer draft tube 19*z* and the sidewall 13*b* of the chamber 13. The spaces 33 act as an upstream passage of the high-viscosity material Z that has passed through the carrying impeller 30 downward.

In addition, the rotating rod 45 is horizontally installed above the draft tubes 19*y*, 19*z*, and two sweeping impellers 47 are respectively fixed to both ends of the rotating rod 34. The rotating rod 45 is fixed to the driving shaft 43 as mentioned above.

The sweeping impellers 47 are rotated together with the carrying impeller 30 with being installed to each of the spaces 33, and thus push the high-viscosity material Z, flowing up and down inside the spaces 33, in a circumferential direction of the draft tubes 19*y*, 19*z*, thereby promoting heat exchange. During this procedure, the heat medium passes through the heat medium passages 15, 21.

Figure 8:
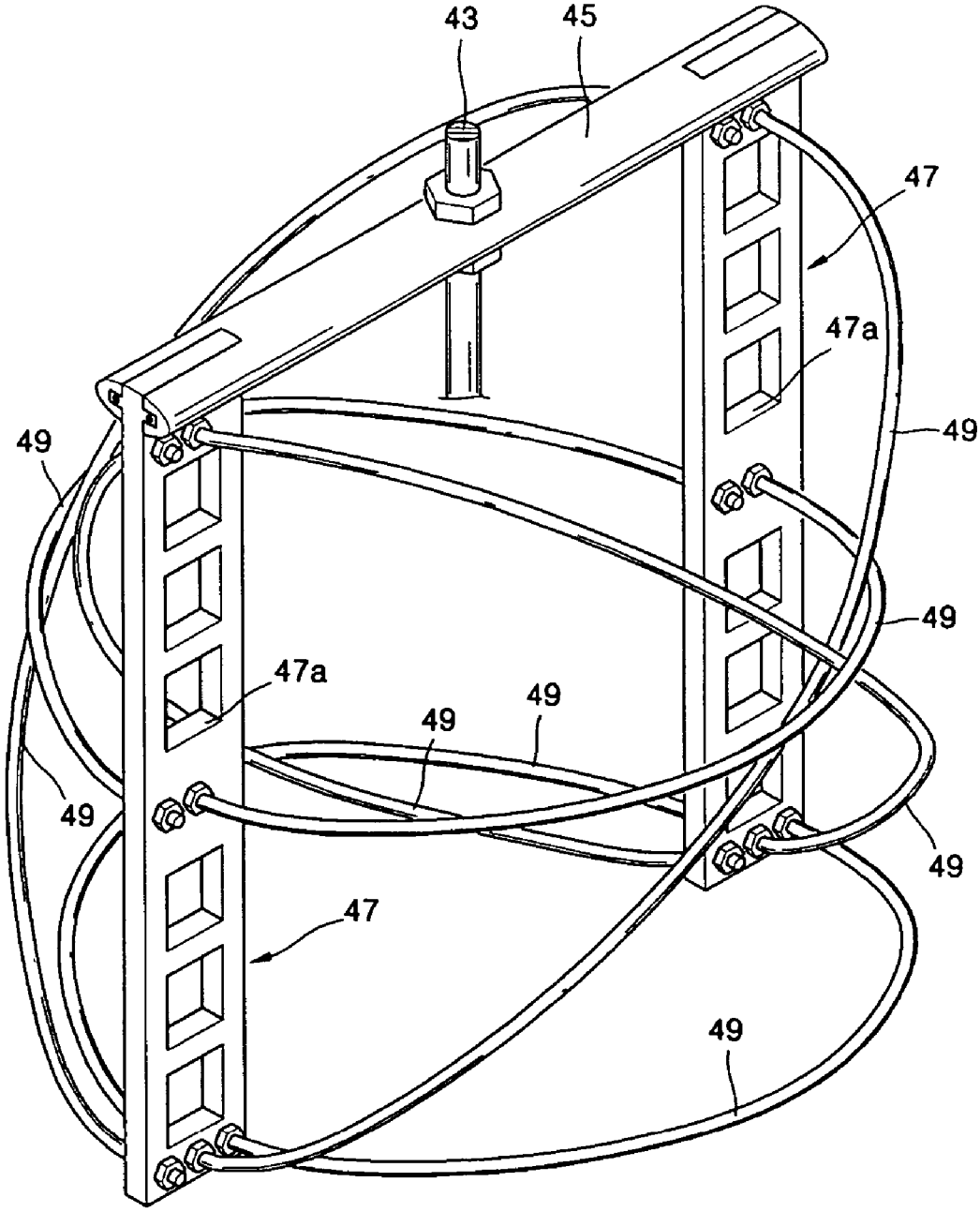
FIG. 8 is a perspective view showing the sweeping impeller of FIG. 4, reinforced with another kind of frames.

FIG. 8 shows that the sweeping impellers of FIG. 4 are reinforced with different kind of frames.

As shown in FIG. 8, such a reinforcing frame 49 may be added to the above frames 49 shown in FIG. 6 as desired if rotation of the sweeping impeller 47 is ensured.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

APPLICABILITY TO THE INDUSTRY

The viscous material mixing apparatus of the present invention configured as mentioned above has good heat exchange efficiency, thereby allowing effective temperature control of the mixed material during the mixing procedure. Accordingly, the viscous material mixing apparatus of the present invention allows production of polymer products, which was impossible by a conventional mixing device, and also reduces an amount of heat medium used, thereby capable of reducing a production cost as much.

What is claimed is:

1. An apparatus for mixing viscous material, comprising:

a chamber having a cylindrical sidewall and a bottom, the chamber receiving viscous material to be mixed;

a cylindrical draft tube fixed at an inside center of the chamber to be spaced apart from the bottom, the draft tube being spaced apart from the sidewall of the chamber and forming a space between the draft tube and the sidewall of the chamber so that the viscous material passes through the space, the draft tube including a heat medium passage therein through which a heat medium supplied from outside passes;

a carrying impeller installed in the draft tube and driven by a power supplied from an external driving means to transfer the viscous material above or below the draft tube and suck the viscous material located in the space into the draft tube; and a sweeping impeller installed in the space and rotated in a circumferential direction of the draft tube with the power supplied from an external driving means to apply a pressure to the viscous material so that the viscous material in the space is not adhered to an outer circumference of the draft tube and an inner circumference of the sidewall of the chamber, wherein the draft tube is fixed to the chamber and does not rotate;

wherein the sweeping impeller has a plate shape with a width (w) corresponding to 85% to 95% of a width of the space, and the plate shape is formed vertically downward toward the bottom of the chamber along the space;

wherein the sweeping impeller is installed not to contact the inner circumference and the outer circumference; and wherein, when the sweeping impeller rotates, space parts (E) are formed between the sweeping impeller and the inner circumference and between the sweeping impeller and the outer circumference, wherein the carrying impeller includes:

a driving shaft positioned on a central axis of the draft tube and axially rotated with a torque transmitted from outside; and a spiral blade fixed to an outer circumference of the driving shaft and extended in a screw shape, the spiral blade having a front end spaced apart from an inner circumference of the draft tube by a predetermined distance, wherein the sweeping impeller has a plate shape parallel with the driving shaft, wherein the apparatus further comprises a rotating rod acting as a driving means for transferring a rotating force to the sweeping impeller, the rotating rod being fixed to the driving shaft and extended to an upper portion of the space, the sweeping impeller being coupled to an end of the rotating rod, wherein there is provided a plurality of rotating rods arranged at regular angles, an upper end of the sweeping impeller is fixed to each rotating rod, and the sweeping impeller is reinforced with frames so as to prevent deformation due to a flow resistance caused by the viscous material while the sweeping impeller is rotating, and wherein one or more of the frames are arranged in the circumferential direction of the draft tube, and another one or more of the frames have one end fixed to the upper end of one sweeping impeller and the other end fixed to the lower end of another sweeping impeller.

2. The apparatus for mixing viscous material according to claim 1, wherein a heat medium passage for allowing a heat medium supplied from outside to pass therethrough is provided in the sidewall of the chamber.

3. The apparatus for mixing viscous material according to claim 1, wherein the sweeping impeller has constant thickness and width, and while being rotated, the sweeping impeller allows an edge thereof in a width direction to separate the viscous material adhered to the inner circumference of the sidewall of the chamber and the outer circumference of the draft tube from an adhesion surface, thereby promoting heat exchange between the corresponding adhesion surface and the beat medium.

4. The apparatus for mixing viscous material according to claim 1, wherein an upper end of the sweeping impeller is fixed to the rotating rod, and the sweeping impeller has a plurality of through holes for the viscous material to pass therethrough so as to reduce a flow resistance caused by the viscous material while the sweeping impeller is rotating.

5. An apparatus for mixing viscous material, comprising:

a chamber having a cylindrical sidewall and a bottom, the chamber receiving viscous material to be mixed;

a plurality of cylindrical draft tubes fixed at an inside center of the chamber to be spaced apart from the bottom, the draft tubes being spaced apart from the sidewall of the chamber with the same center and different diameters, the draft tubes passing the viscous materials through a space between the draft tubes and a space between the greatest draft tube and the sidewall, the draft tubes including heat medium passages therein through which a heat medium supplied from outside passes;

a carrying impeller installed to a smallest one of the draft tubes and driven by the power supplied from an external driving means to carry the viscous material above or below the draft tubes and suck in the viscous material located in the spaces; and a plurality of sweeping impellers installed in the spaces and rotated in a circumferential direction of the draft tubes with the power supplied from an external driving means to apply a pressure to the viscous material so that the viscous material in the spaces is not adhered to facing surfaces of the draft tubes and facing surfaces of the draft tube and the chamber, wherein the draft tube is fixed to the chamber and does not rotate;

wherein the sweeping impeller has a plate shape with a width (w) corresponding to 85% to 95% of a width of the space, and the plate shape is formed vertically downward toward the bottom of the chamber along the space;

wherein the sweeping impeller is installed not to contact the inner circumference and the outer circumference; and wherein, when the sweeping impeller rotates, space parts (E) are formed between the sweeping impeller and the inner circumference and between the sweeping impeller and the outer circumference, wherein the carrying impeller includes:

a driving shaft positioned on a central axis of the draft tube and axially rotated with a torque transmitted from outside; and a spiral blade fixed to an outer circumference of the driving shaft and extended in a screw shape, the spiral blade having a front end spaced apart from an inner circumference of the draft tube by a predetermined distance, wherein the sweeping impeller has a plate shape parallel with the driving shaft, wherein the apparatus further comprises a rotating rod acting as a driving means for transferring a rotating force to the sweeping impeller, the rotating rod being fixed to the driving shaft and extended to an upper portion of the space, the sweeping impeller being coupled to an end of the rotating rod, wherein there is provided a plurality of rotating rods arranged at regular angles, an upper end of the sweeping impeller is fixed to each rotating rod, and the sweeping impeller is reinforced with frames so as to prevent deformation due to a flow resistance caused by the viscous material while the sweeping impeller is rotating, and wherein one or more of the frames are arranged in the circumferential direction of the draft tube, and another one or more of the frames have one end fixed to the upper end of one sweeping impeller and the other end fixed to the lower end of another sweeping impeller.

6. The apparatus for mixing viscous material according to claim 5, wherein a heat medium passage for allowing a heat medium supplied from outside to pass therethrough is provided in the sidewall of the chamber.

7. The apparatus for mixing viscous material according to claim 5, wherein the sweeping impeller has constant thickness and width, and while being rotated, the sweeping impeller allows an edge thereof in a width direction to separate the viscous material adhered to the inner circumference of the sidewall of the chamber and the outer circumference of the draft tube from an adhesion surface, thereby promoting heat exchange between the corresponding adhesion surface and the heat medium.

8. The apparatus for mixing viscous material according to claim 5, wherein an upper end of the sweeping impeller is fixed to the rotating rod, and the sweeping impeller has a plurality of through holes for the viscous material to pass therethrough so as to reduce a flow resistance caused by the viscous material while the sweeping impeller is rotating.

* * * * *